US008062010B2

(12) United States Patent
Paramonoff et al.

(10) Patent No.: US 8,062,010 B2
(45) Date of Patent: Nov. 22, 2011

(54) THERMAL EXPANSION CHAMBERS FOR AIRTIGHT CONTAINERS

(75) Inventors: Alexander Paramonoff, North Vancouver (CA); Robie Ralph, Delta (CA)

(73) Assignee: Teleflex Canada Inc., Richmond (CA)

( * ) Notice: Subject to any disclaimer, the term of this patent is extended or adjusted under 35 U.S.C. 154(b) by 433 days.

(21) Appl. No.: 11/229,615

(22) Filed: Sep. 20, 2005

(65) Prior Publication Data

US 2007/0065322 A1 Mar. 22, 2007

(51) Int. Cl.
*F04B 39/00* (2006.01)

(52) U.S. Cl. ..... 417/572; 417/65; 417/540

(58) Field of Classification Search ..... 60/592, 60/585; 417/543, 410.3, 423.14, 423.11, 417/570, 540, 541, 542, 572, 439, 269, 65, 417/105, 370; 138/26, 30; 137/558, 565.17
See application file for complete search history.

(56) References Cited

U.S. PATENT DOCUMENTS

| | | | | |
|---|---|---|---|---|
| 54,073 | A | 4/1866 | Sewel | |
| 832,710 | A | 10/1906 | Wade | |
| 954,916 | A | 4/1910 | Bewan | |
| 973,474 | A | 10/1910 | Cameron | |
| 1,150,122 | A | 8/1915 | Jaawne | |
| 1,155,070 | A | 9/1915 | Kessler | |
| 1,192,134 | A | 7/1916 | Stevens | |
| 1,304,195 | A | 5/1919 | Noeth et al. | |
| 2,531,765 | A | 11/1950 | Burress | |
| 3,064,307 | A | 11/1952 | Sanborn | |
| 3,180,376 | A | 4/1965 | Sanborn | |
| 3,426,691 | A * | 2/1969 | Anderson | 417/370 |
| 3,483,656 | A | 12/1969 | Baumann | |
| 3,853,147 | A * | 12/1974 | Cibulka | 138/30 |
| 4,028,444 | A | 6/1977 | Brown et al. | |
| 4,201,056 | A | 5/1980 | De Martelaere et al. | |
| 4,210,176 | A | 7/1980 | Emming | |
| 4,355,512 | A | 10/1982 | Kubota et al. | |
| 4,445,829 | A * | 5/1984 | Miller | 417/543 |
| 4,487,021 | A | 12/1984 | Arakawa et al. | |
| 4,514,151 | A * | 4/1985 | Anders et al. | 417/540 |
| 4,525,126 | A * | 6/1985 | Laumont | 417/310 |
| 4,759,659 | A * | 7/1988 | Copie | 404/117 |
| 4,805,668 | A | 2/1989 | Genter et al. | |
| 5,081,908 | A * | 1/1992 | McBeth et al. | 91/499 |
| 5,137,431 | A * | 8/1992 | Kiyoshi et al. | 417/269 |
| 5,277,552 | A * | 1/1994 | Higuchi | 417/222.2 |

(Continued)

OTHER PUBLICATIONS

U.S. Appl. No. 10/076,612, filed Aug. 2003, Dudra et al.

*Primary Examiner* — Devon C Kramer
*Assistant Examiner* — Leonard Weinstein
(74) *Attorney, Agent, or Firm* — Cameron IP

(57) ABSTRACT

A hydraulic pump has a rotor and a hollow housing with a main interior chamber. The rotor is rotatably mounted in the main interior chamber. A smaller interior chamber is separated from the main interior chamber such that the smaller interior chamber retains gas therein when the main interior chamber is filled with a liquid. There is also a method for accommodating changes in volume of hydraulic fluid within the main chamber of the hydraulic pump housing. The method comprises providing the smaller interior chamber separated from the main chamber and retaining gas within the smaller chamber when the main interior chamber is filled with liquid, whereby expansion or contraction of the gas accommodates changes of volume of the liquid within the housing.

1 Claim, 4 Drawing Sheets

U.S. PATENT DOCUMENTS 5,282,725 A * 2/1994 Shimizu ..... 417/222.1
5,356,535 A 10/1994 Ueno et al.
5,413,468 A * 5/1995 Tuckey ..... 417/540
5,796,197 A * 8/1998 Bookout ..... 310/85
5,957,545 A 9/1999 Sawada et al.
6,268,672 B1 * 7/2001 Straub et al. ..... 310/87
6,692,166 B2 2/2004 Ansell et al.
7,171,982 B2 2/2007 Dudra
7,246,636 B2 7/2007 Dudra
2003/0155015 A1 * 8/2003 Dudra et al. ..... 137/558

* cited by examiner

THERMAL EXPANSION CHAMBERS FOR AIRTIGHT CONTAINERS

BACKGROUND OF THE INVENTION

This invention relates to thermal expansion chambers for airtight containers such as housings for hydraulic systems and to methods for accommodating changes in volume of hydraulic fluid within such systems.

Hydraulic pumps include a hollow housing. The housing is airtight, but has input and output ports for hydraulic fluid. The fluid may become heated during operation of the pump as well as during operation of hydraulic devices connected to the pump. The fluid expands when heated and, where the pump housing is an airtight container, the fluid will generate pressure that can increase stresses on the pump housing which may lead to leakage of the hydraulic fluid or damage to components.

Accordingly, it would be desirable to provide a hydraulic pump which could accommodate varying volumes of hydraulic fluid within its housing.

SUMMARY OF THE INVENTION

According to one aspect of the invention, there is provided a hydraulic pump comprising a rotor and hollow housing. The housing has a main interior chamber, the rotor being rotatably mounted in the main interior chamber. There is a smaller interior chamber separated from the main interior chamber such that the smaller interior chamber retains gas therein when the main interior chamber is filled with a liquid, thereby accommodating changes of volume of the liquid within the hollow housing.

According to another aspect of the invention, there is provided a method for accommodating changes in volume of hydraulic fluid within a main chamber of a hydraulic pump housing for a hydraulic pump. The method comprises providing a smaller interior chamber separated from the main chamber and retaining gas within the smaller chamber when the main interior chamber is filled with liquid. Expansion or contraction of the gas accommodates changes of volume of the liquid within the housing.

BRIEF DESCRIPTION OF THE DRAWINGS

In drawings which illustrate embodiments of the invention.

DETAILED DESCRIPTIONS OF THE PREFERRED EMBODIMENTS

Figure 1:
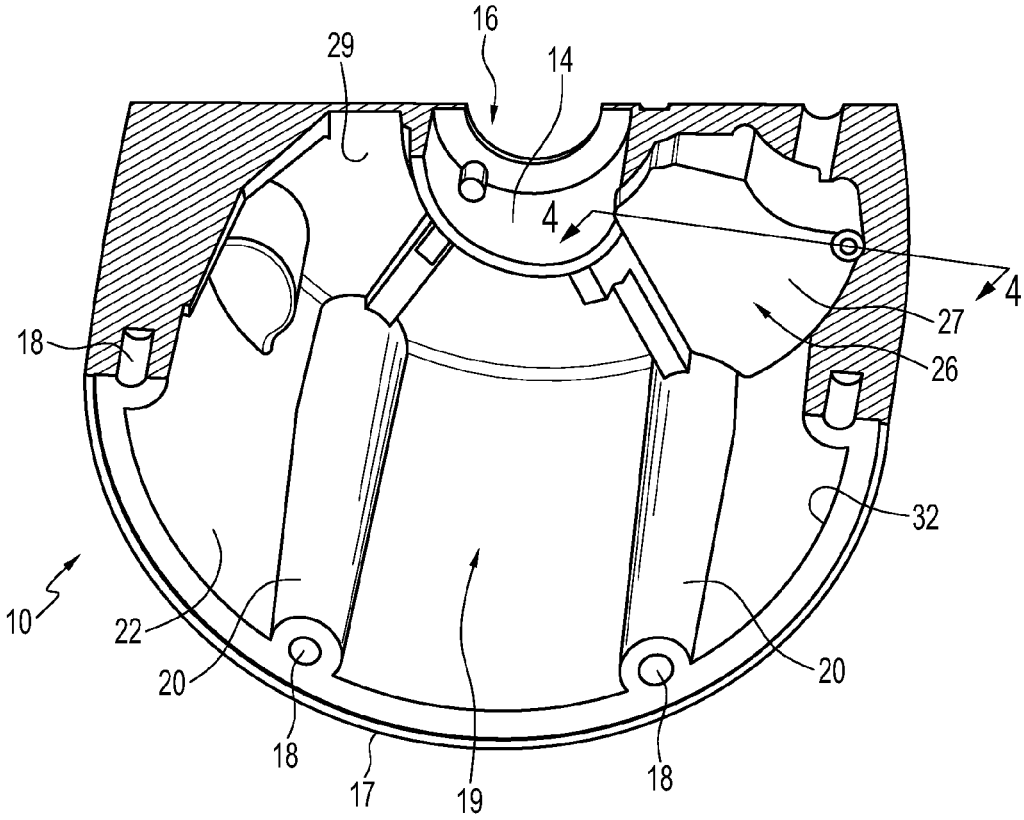
FIG. 1 is a fragmentary bottom, isometric view of one section of a housing of a hydraulic pump, showing the interior of the housing and an expansion chamber thereof, according to an embodiment of the invention.

Referring to FIG. 1, this shows one section of a housing 10 of a hydraulic pump which is generally conventional in configuration. The housing 10 has a bearing at each end including bearing 14 disposed adjacent aperture 16 for rotatably supporting the shaft of a rotor (not shown). FIG. 1 shows only one half 17 of a top half of the housing 10. A plurality of cylindrical recesses 18 are located in enlarged semicylindrical protrusions 20 which are spaced-apart about an inner cylindrical wall 22 of the housing. These recesses receive bolts or other fasteners for securing housing half 17 to another similar half of the housing (not shown) having another bearing similar to bearing 14 for supporting the opposite end of the rotor shaft. A suitable seal (not shown) extends about the housing between the two halves thereof. The housing 10 has a main interior chamber 19 with a top 29.

The overall structure of housing half 17 is conventional and therefore is not disclosed in more detail. However, housing 10 is unconventional because it incorporates a smaller interior chamber or expansion chamber 26 which is separated from the main interior chamber 19. The expansion chamber 26, in this example, has a hollow housing 27 made of thin wall, blowmolded plastic and is located adjacent to the top 29 of the main interior chamber 19 in this embodiment. Polypropylene is used in this example, although other plastics such as polyethylene or other plastics or metals could be substituted. Polypropylene was found to withstand the oil and temperature better than polyethylene although the latter is more commonly used for such parts.

Although the invention, as described above, is used in a rotor piston-type hydraulic pump it will be known to a person skilled in the art that the invention may be used in other types of hydraulic pumps such as gear pumps or gerotor pumps.

Figure 2:
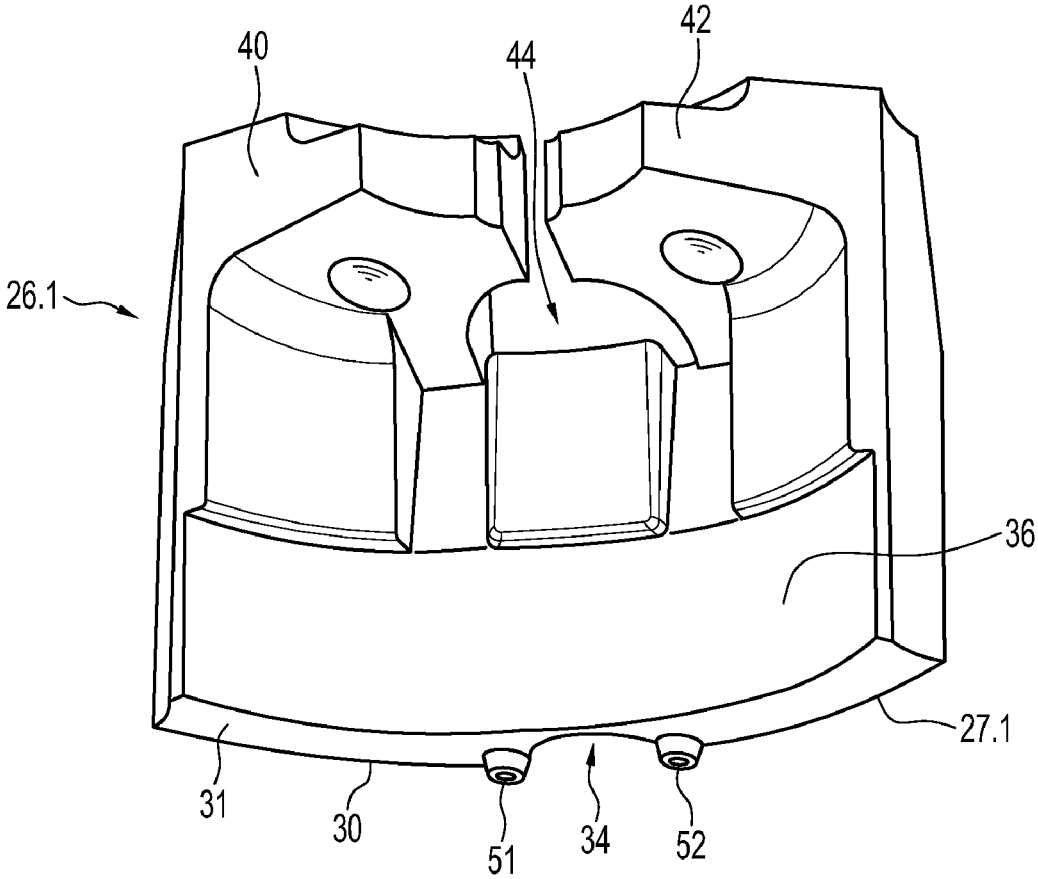
FIG. 2 is a front isometric view of an expansion chamber, according to another embodiment of the invention.
Figure 3:
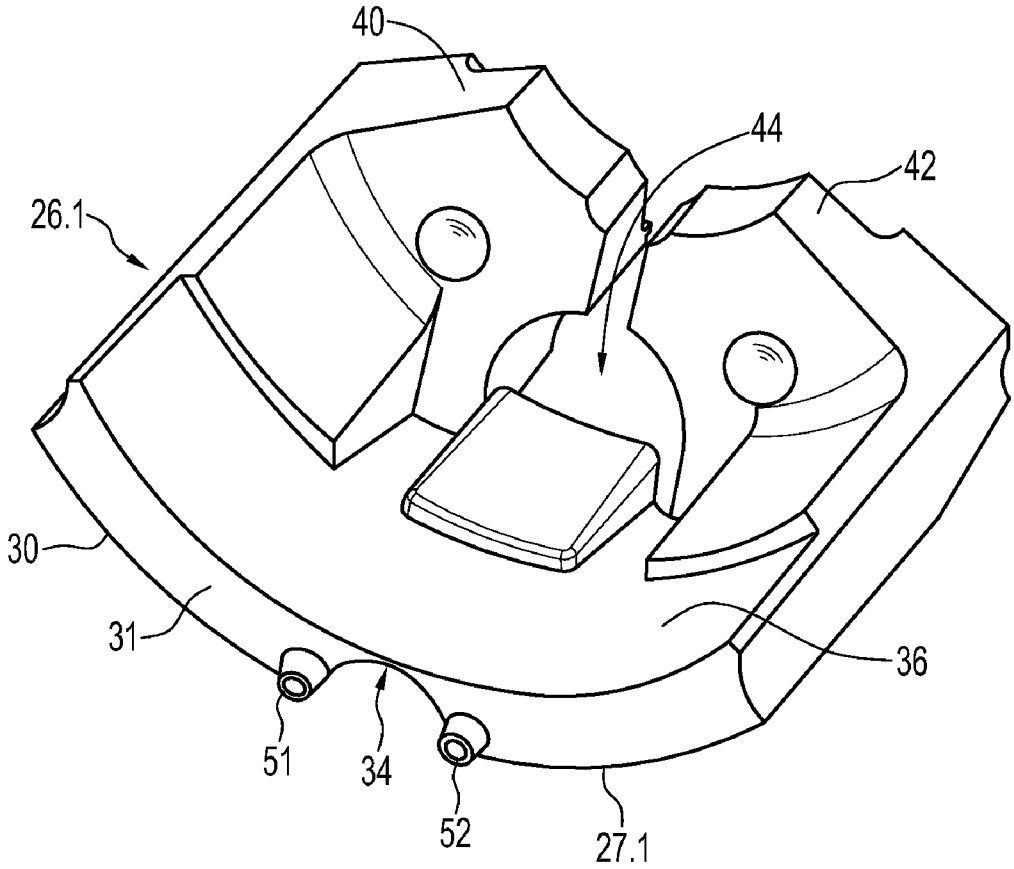
FIG. 3 is a bottom isometric view of the expansion chamber of FIG. 2.
Figure 4:
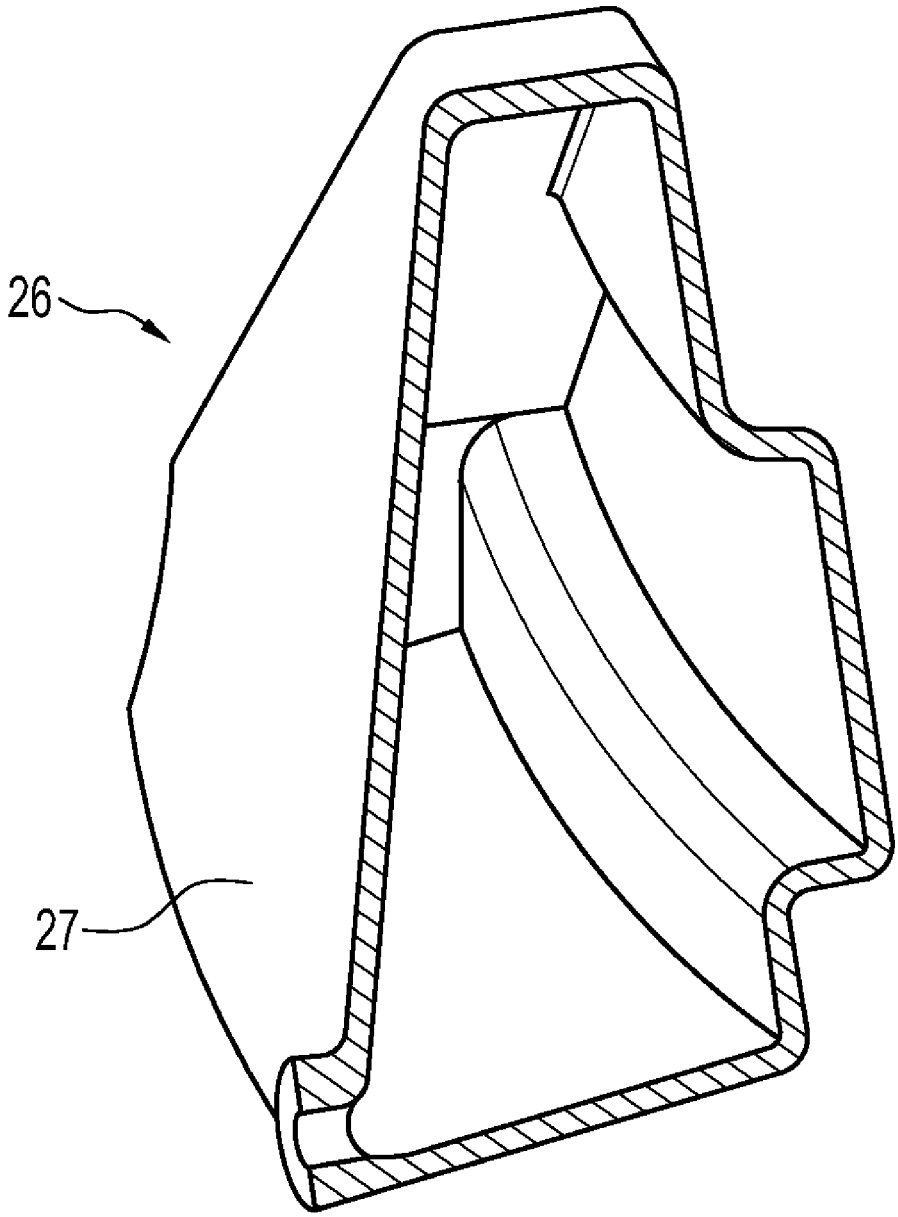
FIG. 4 is a sectional view of the expansion chamber of FIG. 1 taken along line 4-4 of FIG. 1.

Referring to FIG. 2, another embodiment of the expansion chamber 26.1 is shown where like parts have like reference numerals with the additional designation ".1". The housing 27.1 of the expansion chamber 26.1 has a convexly curved surface 30 shaped to fit against concavely shaped surface 32 of the housing 10 shown in FIG. 1. There is a semicylindrical recess 34 shaped to fit over one of the semicylindrical protrusions 20 of the housing 10. The expansion chamber housing 27.1 in this example has a C-shaped portion 36 adjacent to convexly curved surface 30. C-shaped portion 36 is connected to two adjacent portions 40 and 42 which extend away from convexly curved surface 30. There is an opening 44 between adjacent portions 40 and 42 which allows communication between the interior of the housing 10, shown in FIG. 1, and one of the ports of the pump.

There is a pair of small passageways 51 and 52 adjacent to the bottom 31 of the housing 27.1. The passageways 51 and 52 permit communication between the expansion chamber 26.1 and the main interior chamber 19 of the housing 10, shown in FIG. 1. The passageways 51 and 52 are sufficiently large to permit fluid to enter or exit the expansion chamber 26.1. The passageways 51 and 52 face downwardly to inhibit air or other gas within the expansion chamber 26.1 from, exiting the expansion chamber. The contraction or expansion of gas within the expansion chamber 26.1 accommodates changes in the volume of fluid within the main, interior chamber 19 by allowing fluid to enter or exit the expansion chamber 26.1.

The housing 27.1 could be shaped differently than shown in the drawings. Also the blowmolded housing could be replaced with a more rigid structure, optionally integral with the housing 10 or with a flexible bladder containing air or in other gas. Alternatively, the housing 27.1 could be replaced by a resilient foam member, preferably a closed cell foam.

It will be understood by someone skilled in the art that many of the details provided about are by way of example only and may be varied or deleted without departing from the scope of the invention as set forth in the following claims.

What is claimed is:

1. An assembly for a hydraulic pump comprising:

a housing having an inner wall, the inner wall defining a periphery of a sealed main chamber;

a pump port in fluid communication with the sealed main chamber;

an aperture in the housing and a bearing disposed adjacent the aperture for rotatably supporting a rotor shaft which extends through the aperture into the sealed main chamber; and a smaller chamber fixedly attached . . . so that the smaller chamber retains gas by trapping the gas within a housing of the smaller chamber, wherein the smaller chamber is provided with only a single passageway, wherein the single passageway of the smaller chamber is configured to be blocked by a hydraulic fluid when the sealed main chamber is filled with the hydraulic fluid, the smaller chamber being provided with the single passageway to permit fluid communication between the smaller chamber and the sealed main chamber thereby accommodating thermal expansion of hydraulic fluid in the sealed main chamber.

* * * * *

UNITED STATES PATENT AND TRADEMARK OFFICE

CERTIFICATE OF CORRECTION

PATENT NO. : 8,062,010 B2
APPLICATION NO. : 11/229615
DATED : November 22, 2011
INVENTOR(S) : Alexander Paramonoff and Robie Ralph It is certified that error appears in the above-identified patent and that said Letters Patent is hereby corrected as shown below:

In claim 1 replace "..." at column 3, line 7, with "to the inner wall of the sealed main chamber and separated from the sealed main chamber".

Signed and Sealed this
Fourteenth Day of February, 2012

David J. Kappos

David J. Kappos
*Director of the United States Patent and Trademark Office*